US006588547B2

(12) United States Patent
Yeh

(10) Patent No.: US 6,588,547 B2
(45) Date of Patent: Jul. 8, 2003

(54) JOINT FOR AN ARTICULATED LADDER

(76) Inventor: Chin-wen Yeh, 57 Wuhsun St., Keelung (TW)

( * ) Notice: Subject to any disclaimer, the term of this patent is extended or adjusted under 35 U.S.C. 154(b) by 0 days.

(21) Appl. No.: 09/969,919

(22) Filed: Oct. 3, 2001

(65) Prior Publication Data

US 2003/0062219 A1 Apr. 3, 2003

(51) Int. Cl.[7] ..... E06C 1/00
(52) U.S. Cl. ..... 182/163; 403/93
(58) Field of Search ..... 182/163; 403/93

(56) References Cited

U.S. PATENT DOCUMENTS 5,992,566 A * 11/1999 Yeh ..... 182/163

* cited by examiner

*Primary Examiner*—Alvin Chin-Shue
(74) *Attorney, Agent, or Firm*—Connolly Bove Lodge & Hutz LLP

(57) ABSTRACT

A joint for an articulated ladder comprises two outer casing parts, two inner casing parts, an arched lock piece, and an extension spring. The inner casing parts pivotally engages with the outer casing parts and the arched lock piece is located in the inner casing parts. The spring has one hook end thereof engaging with the locating tab of one of the inner casing parts. The arched lock piece is an integral piece providing with two parallel arched parts spacing apart from each other. Each of the parallel arched parts further provides three short posts extending outward from a facial side thereof to be slidably received in the three arched openings on the inner casing parts respectively. A hook tongue extends outward from one of the flat connecting parts to engage with the other hook end of the spring.

1 Claim, 3 Drawing Sheets

JOINT FOR AN ARTICULATED LADDER

BACKGROUND OF THE INVENTION

1. Field of The Invention

The present invention relates to a joint for an articulated ladder, and particularly to an arched lock piece disposed in the joint.

2. Description of Related Art

Due to a plurality of joints being mounted, an articulated ladder can be operated conveniently to obtain different preset angles among the ladder sections thereof. Conventionally, each of the joints has a positioning lock device therein so that a reliable operation of the articulated ladder can be achieved securely. However, many types of positioning lock devices have been developed so that each lock device makes the corresponding joint have its own way of operation.

The joint for an articulated ladder of the present invention is derived from German Utility Model No. 29600583.5 and U.S. Pat. No. 5,992,566, that is, the joint of the present invention is an improvement on German Utility Model No. 29600583.5 and U.S. Pat. No. 5,992,566. The German Utility Model No. 29600583.5 provides two inner casing parts with three locating recesses thereon respectively. Each of the locating recesses corresponding to a locating pin associated with an extension spring to constitute a catch device such that a trigger can be actuated to move a lock block in one of the locating recesses in case of the joint being operated to fold or to expand the articulated ladder. The catch device composed of three locating pins and three extension springs is attached in the inner casing parts so that it is quite sophisticated from the standpoint of the assembling job. Further, each extension spring at an end thereof is attached to the respective locating pin and at the other end thereof is attached to one of the inner casing parts so that it may cause a problem of jamming once the respective locating pin is subjected to an unbalanced pulling force of the respective extension spring.

The U.S. Pat. No. 5,992,566 provides two embodiments and one of the embodiments is characterized in that the catch device is composed of an arched block with three locating through holes, three locating pins, and an extension spring. Another embodiment of the U.S. Pat. No. 5,992,566 is characterized in that the catch device is composed of an arched block integral with three pairs of circular projections, and an extension spring. The catch device disclosed in the U.S. Pat. No. 5,992,566 is much simpler than that disclosed in the German Utility No. 29600583.5 for the assembling job. In addition, the U.S. Pat. No. 5,992,566 provides only one spring to move the arched block so that it is much more steady for the arched block during moving.

However, it is a problem that to fabricate the arched block disclosed in the U.S. Pat. No. 5,992,566 accurately takes more time and much more costly. The present inventor has endeavored to overcome the problem and discloses the present invention.

SUMMARY OF THE INVENTION

An object of the present invention is to provide a joint for an articulated ladder, which comprises an arched ring plate integral with three drawn short posts to be simply made and to perform a better function of catch device.

BRIEF DESCRIPTION OF THE DRAWINGS

The present invention can be more fully understood by referencing to the following detailed description and accompanying drawings, in which.

DETAILED DESCRIPTION OF THE PREFERRED EMBODIMENT

Figure 1:
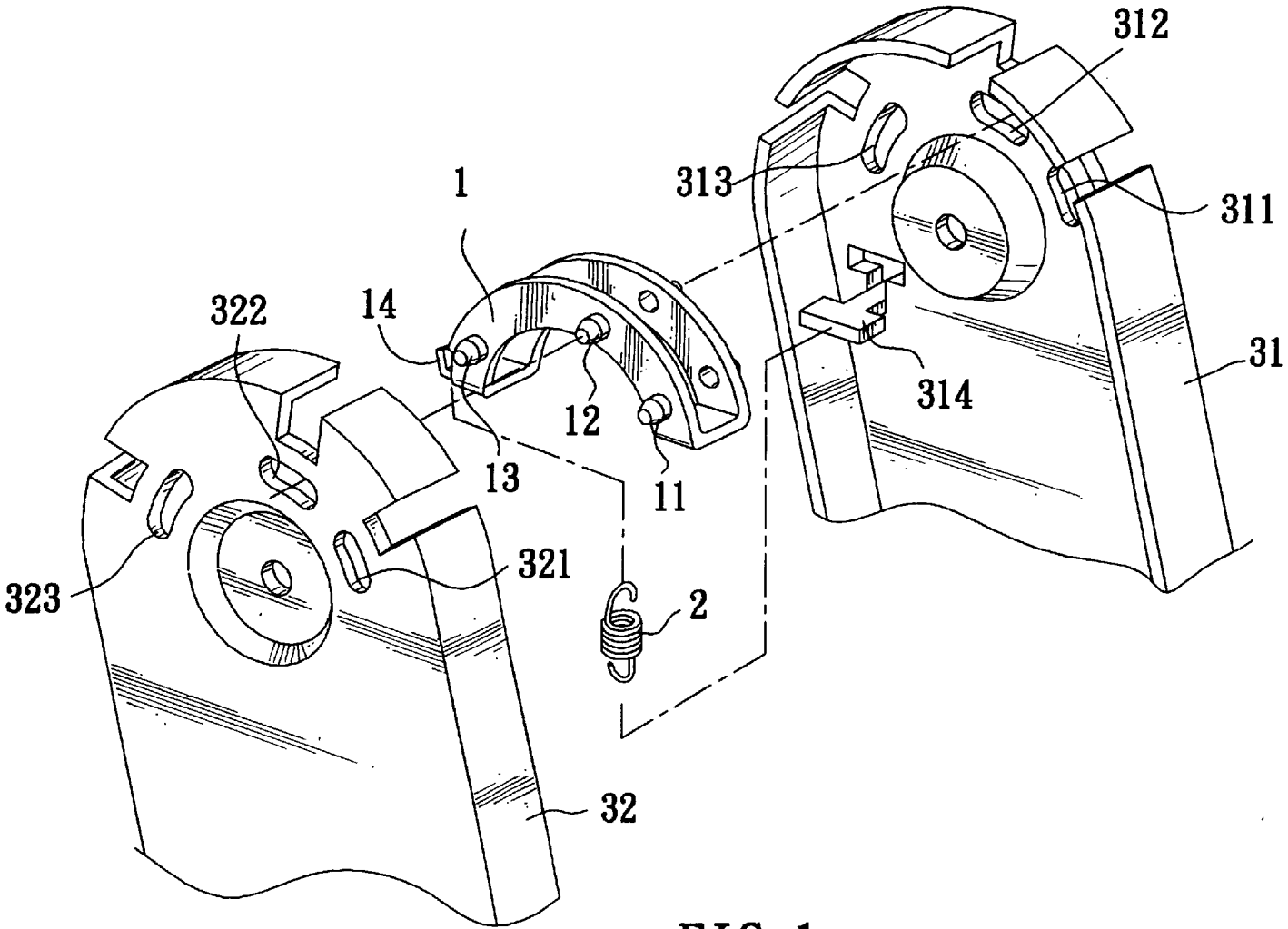
FIG. 1 is an exploded perspective fragmentary view of a joint for an articulate joint according to the present invention illustrating a positioning lock device being detached from inner casing parts thereof.
Figure 2:
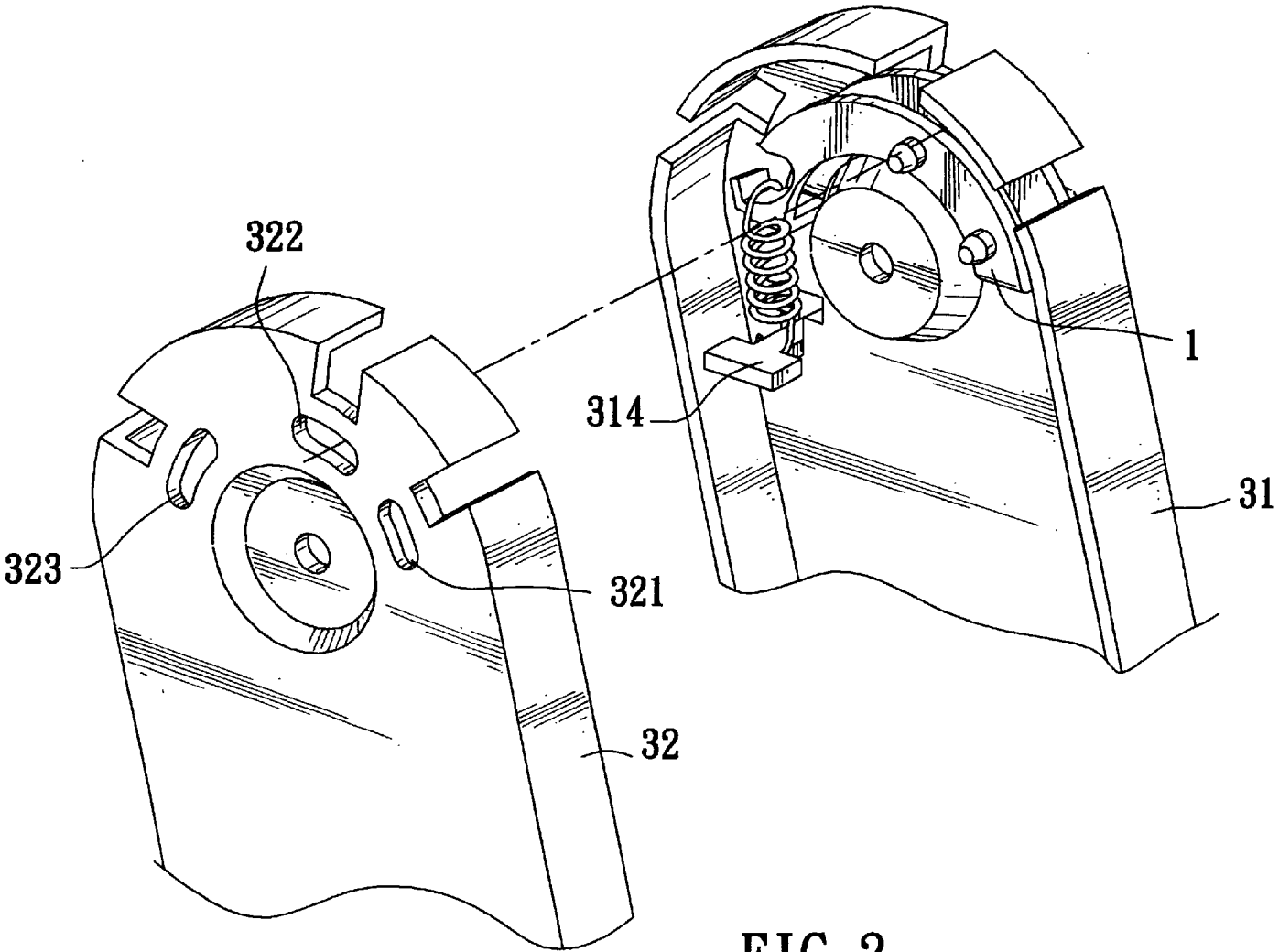
FIG. 2 is a perspective view similar to FIG. 1 illustrating the positioning lock device having been attached to one of the inner casing parts.
Figure 3:
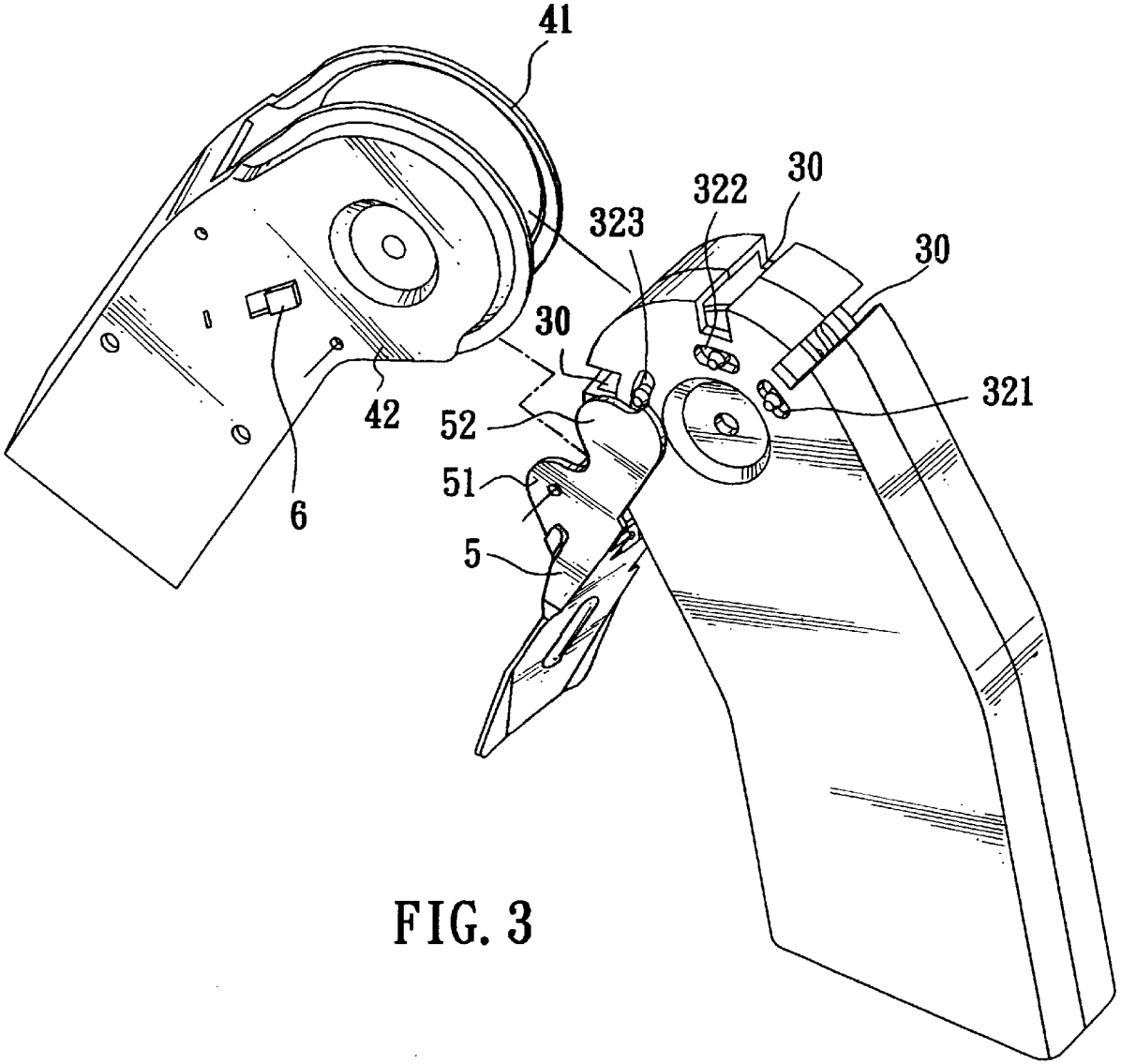
FIG. 3 is a perspective view of the joint for an articulated ladder according to the present invention illustrating outer casing parts thereof being detached from the inner casing parts and the positioning lock device thereof having been assembled with the inner casing parts.

Referring to FIGS. 1, 2, and 3, a joint for an articulated ladder according to the present invention provides a positioning lock device and the positioning lock device basically comprises an arched lock piece 1 and an extension spring 2. The arched piece 1 has two integral parallel arched plate parts and the arched plate parts at both ends thereof are a flat connecting part respectively. The respective arched plate part at the outer lateral side thereof provides two sets of three short cylindrical posts 11, 12, 13, which are spaced apart, respectively to correspond to three elongated arched openings (311, 312, 313) and (321, 322, 323) passing through the inner casings 31, 32 respectively. Thus, the two sets of the short posts 11, 12, 13 can be slidably received in the arched openings (311, 312, 313) and (321, 322, 323) on the inner casing parts 31, 32 respectively. One of the connecting parts on the arched lock piece extends-outward a hook tongue 14 for an end of the spring 2 connecting with the hook tongue 14 and the outer end of the hook tongue 14 is an upward hook end so that the end of the spring 2 can be located at the hook tongue 14 steadily. The spring 2 at both ends thereof provides a shape of hook respectively so that an end thereof can connect with the preceding hook tongue 14 and the other end thereof can be attached to a locating piece 25 extending horizontally from the inner casing 32. Hence, the arched lock piece 1 can be exerted by a force to move along with the two sets of the short posts 31, 32, 33 sliding in the arched openings (311, 312, 313) and (321, 322, 323) against the resilient resistance of the spring 2.

Next, referring to FIG. 3 again, the arched lock piece 1 has a size to be received properly in a space confined by the inner casing parts 31, 32 as soon as the inner casing parts 31, 32 are joined to each other oppositely, and the three short post parts 11, 12, 13 at both lateral sides of the arched lock piece 1 are slidably received in the arched openings (311, 312, 313) and (321, 322, 323) on the inner casings 31, 32 respectively. The elongated trigger piece 5 at the upper bifurcate part thereof is received in and pivotally engages with the outer casing parts 41, 42, and the upper bifurcate part provides two parallel side plates corresponding to each other with a belly 51 and a curve top 52 on the respective side plate. When the outer casing parts 41, 42 are joined to each other oppositely and pivotally engage with the inner casing parts 31, 32, the bifurcate part of the trigger piece 5 reaches to the inner casing parts 31, 32 and the space between the side plates are occupied by the inner casing parts 31, 32. Further, the respective belly 51 is disposed against the lock block 6 and the respective curve top 52 is disposed against the short post part 323 as soon as the outer casing parts 41, 42 has assembled with the inner casing parts 31, 32. As soon as the trigger piece 5 at the lower part thereof is pressed in the direction of unlocking, the belly 51 can urge the lock block 6 to move away one of three locating recesses 30 on the inner casing parts and the trigger piece 5 stays at the position of unlocking due to the respective curve top 52 urges the arched lock piece 1 against the resilient force of the spring 2. Right at this time, the outer casing parts 41, 42 and the inner casing parts 31, 32 can be turned an angle relatively till the lock block 6 entering another one of the three locating recesses 30, and the trigger piece 5 is restored to the position of locking. It is noted that the inner casing parts 31, 32, the outer casing parts 41, 42, the trigger piece 5, and the lock block 6 are belonged to the prior art so that no detail will be described further.

It is appreciated that the arched lock piece 1 of the joint for an articulated ladder according to the present invention is an integral piece composed of the parallel arched parts, the connecting parts and the short post parts so that it is much simpler than that disclosed in the U.S. Pat. No. 5,992,566. The U.S. Pat. No. 5,992,566 disclosed an arched plate with a movable pin to constitute a lock piece and an arched plate attached with three arc projections to constitute a lock piece, and these two types of lock pieces are needed longer time to make and provide no better function than the present invention. Furthermore, the ached lock piece of the present invention has no need of a locating hole, which is done in the prior art, so that the present invention is stronger than the prior art definitely.

While the invention has been described with reference to a preferred embodiment thereof, it is to be understood that modifications or variations may be easily made without departing from the spirit of this invention, which is defined by the appended claim.

What is claimed is:

1. A joint for an articulated ladder, including two outer casing parts;

two inner casing parts, being pivotally engaging with the outer casing part, each of the inner casing parts having three arched openings spacing apart from each other and one of the inner casing parts providing a locating tab;

an arched lock piece, being located in the inner casing parts; and spring with two hook ends, one of the hook ends engaging with the locating tab and another one of the hook ends engaging with the arched lock piece;

characterized in that the arched lock piece (1) has two parallel arched plate parts spacing apart from each other with two ends thereof having a flat connecting part respectively, each of the arched plate parts has three short cylindrical posts (11, 12, 13) extending outward from a facial side thereof and spacing apart from each other and one of the connecting parts extends outward a hook tongue (14);

whereby, once the three cylindrical posts on each of the arched plate parts are slidably received in the three arched openings respectively and the tongue engages with the another hook ends of the spring, the articulated joint can adjustably perform a function of positioning lock.

* * * * *